US012478194B2

(12) United States Patent
Longenecker et al.

(10) Patent No.: US 12,478,194 B2
(45) Date of Patent: Nov. 25, 2025

(54) QUICK CONNECTING CHILD BOOSTER SEAT

(71) Applicant: ARTSANA USA, INC., Lancaster, PA (US)

(72) Inventors: Michael L. Longenecker, Lancaster, PA (US); Raymond Evan Good, Lancaster, PA (US)

(73) Assignee: Artsana USA, Inc., Lancaster, PA (US)

( * ) Notice: Subject to any disclaimer, the term of this patent is extended or adjusted under 35 U.S.C. 154(b) by 0 days.

(21) Appl. No.: 18/643,256

(22) Filed: Apr. 23, 2024

(65) Prior Publication Data

US 2024/0268567 A1 Aug. 15, 2024

Related U.S. Application Data

(63) Continuation of application No. 17/939,383, filed on Sep. 7, 2022, now Pat. No. 11,992,132.

(51) Int. Cl.
*A47D 1/10* (2006.01)
*A47D 1/00* (2006.01)

(52) U.S. Cl.
CPC ..... *A47D 1/103* (2013.01); *A47D 1/006* (2013.01); *A47D 1/10* (2013.01)

(58) Field of Classification Search
CPC ..... A47D 1/103; A47D 1/006; A47D 1/106
See application file for complete search history.

(56) References Cited

U.S. PATENT DOCUMENTS

| | | | | |
|---|---|---|---|---|
| 628,306 | A | 7/1899 | Farrington | |
| 2,521,281 | A | 9/1950 | Brousseau | |
| 2,935,122 | A | 5/1960 | Miller | |
| 3,126,226 | A | 3/1964 | Johnson | |
| 3,222,104 | A * | 12/1965 | Remington | A47D 11/00 297/254 |
| 4,629,247 | A | 12/1986 | Wu | |
| 5,335,968 | A | 8/1994 | Sheridan et al. | |
| 7,032,970 | B1 * | 4/2006 | Kharat | A47D 1/103 297/344.18 |
| 7,422,276 | B2 | 9/2008 | Flannery | |
| 9,603,464 | B2 | 3/2017 | Sclare et al. | |
| 2018/0146793 | A1 | 5/2018 | Longenecker et al. | |

FOREIGN PATENT DOCUMENTS

WO 2018199765 A1 11/2018

* cited by examiner

*Primary Examiner* — David R Dunn
*Assistant Examiner* — Tania Abraham
(74) *Attorney, Agent, or Firm* — Saxton & Stump, LLC

(57) ABSTRACT

A portable booster seat for supporting a child on a chair having a retractable clamping arm that is extendable to an underside surface of a chair seat and selectively moveable to clamp the booster seat to the chair.

18 Claims, 14 Drawing Sheets

QUICK CONNECTING CHILD BOOSTER SEAT

CROSS-REFERENCE TO RELATED APPLICATIONS

This application is a continuation of patent application Ser. No. 17/939,383 filed on Sep. 7, 2022, the entirety of which is incorporated by reference herein.

FIELD OF THE INVENTION

This invention relates generally to portable seating for small children, and more particularly to a booster seat that may be quickly and conveniently attached to a seating surface of a chair or the like wherein securing the booster seat to the chair is managed though an easy-to-use user interface.

BACKGROUND OF THE INVENTION

Portability and convenience of use of childcare accessories are increasingly important considerations among consumers. This is particularly important for child booster seats. Booster seats are designed to be placed in the seat of a chair to elevate a child occupant for improved access to an adjacent table. It is necessary to secure the booster seat to the chair to prevent the child from moving the booster seat to the point at which the booster seat falls from the chair. Known methods for securing the booster seats include straps and clamping mechanism, all of which are typically cumbersome to use suffer from somewhat compromised connection integrity.

What is needed is a booster seat having an easy-to-use mechanism for securing a booster seat to a chair or the like in which the mechanism also retracts into the booster seat when not in use would overcome limitations in the known art and be inherently beneficial. Other features and advantages will be made apparent from the present specification. The teachings disclosed extend to those embodiments that fall within the scope of the claims, regardless of whether they accomplish one or more of the aforementioned needs.

SUMMARY OF THE INVENTION

Accordingly, the present invention, in any of the embodiments described herein, may provide one or more of the following advantages:

It is an object of the present invention to provide a portable child booster seat configured for attachment to a chair that includes a clamping mechanism for securing the seat to the chair that may be stowed within the periphery of the seat when not in use. The seat includes a moveable clamping arm connected at one end to the seat and having a drop-down portion with a moveable foot on the opposite end. The clamping arm is moveable between a clamping configuration and a stowed configuration. The clamping configuration allows the drop-down portion of the clamping arm to extend below the chair seat so that the moveable foot may be positioned adjacent to the underside of a chair seat. The clamping arm is rotatable for stowage so that clamping arm may be disposed within a recess in the bottom of the booster seat.

It is a still further object of the present invention to provide a portable child booster seat configured for attachment to a chair and having a clamping mechanism that is easy to operate and secure in attachment. The clamping mechanism comprises a moveable clamping arm connected at one end to the booster seat and having a drop-down frame portion with a moveable clamping foot on the opposite end. An intermediately disposed rotary connection provided in the clamping arm proximate to the clamping foot allows the clamping foot to be repositioned to provide additional clearance to extend the clamping arm beneath the chair seat. The clamping configuration allows the drop-down frame portion to extend below the chair seat so that the clamping foot may be positioned adjacent to the underside of a chair seat. A clamping mechanism manages movement of sliding block that couples the clamping arm to the seat base. A tensioning mechanism is provided to operate the clamping mechanism and retain it in a clamped configuration to secure the booster seat to a chair.

It is a further object of the present invention to provide an easily operable clamping mechanism for securely attaching a portable child booster seat to a chair. The clamping mechanism comprises a moveable clamping arm connected at one end to the booster seat and having a drop-down frame portion with a moveable clamping foot on the opposite end. The clamping configuration allows the drop-down frame portion to extend below the chair seat so that the clamping foot may be positioned adjacent to the underside of a chair seat. The clamping mechanism interface with the clamping arm permits bi-directional movement along a longitudinal axis to enable the clamping arm to be forwardly extended from the seat base and provide clearance between the clamping arm and the forward end of the chair seat while the booster seat is positioned thereon. The clamping mechanism interface with the clamping arm also enable rotational movement of the clamping arm about the longitudinal axis, but only when the clamping arm is linearly positioned in a retracted position. The rotational movement permits the clamping arm to be stowed within a recess formed in the seat base assembly and allow the booster seat to rest stably on a surface when the clamping arm is stowed.

It is a still further object of the present invention to provide an easily operable clamping mechanism for securely attaching a portable child booster seat to a chair that is durable in construction, inexpensive of manufacture, carefree of maintenance, easily assembled, and simple and effective to use.

These and other objects are achieved in accordance with the present invention by providing a portable child booster seat configured for attachment to a chair and having a moveable clamping arm that is easy to operate and secure the booster seat to a chair. The clamping arm is connected at one end to a clamping mechanism disposed on the seat base and has a drop-down frame portion with a moveable clamping foot on the opposite end. The clamping arm is moveable between a clamping configuration and a stowed configuration. The clamping arm may be stowed within a storage recess within base assembly when not in use. The clamping configuration allows the drop-down frame portion of the clamping to extend around the forward end of a chair seat and below the seat so that the clamping foot may be positioned adjacent to the underside of a chair seat. A tensioning mechanism repositions the clamping mechanism to bring the clamping foot into contact with the chair seat and apply a clamping force which retains the booster seat secure to the chair.

Other features and advantages of the present invention will be apparent from the following more detailed description of the preferred embodiment, taken in conjunction with the accompanying drawings which illustrate, by way of example, the principles of the invention.

BRIEF DESCRIPTION OF DRAWINGS

The advantages of this invention will be apparent upon consideration of the following detailed disclosure of the invention, especially when taken in conjunction with the accompanying drawings wherein.

Wherever possible, the same reference numbers will be used throughout the drawings to represent the same parts.

DETAILED DESCRIPTION OF THE INVENTION

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience and are determined as the seat frame would normally be positioned when clamped to a chair seat or similar surface to support a child. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail.

Figure 1:
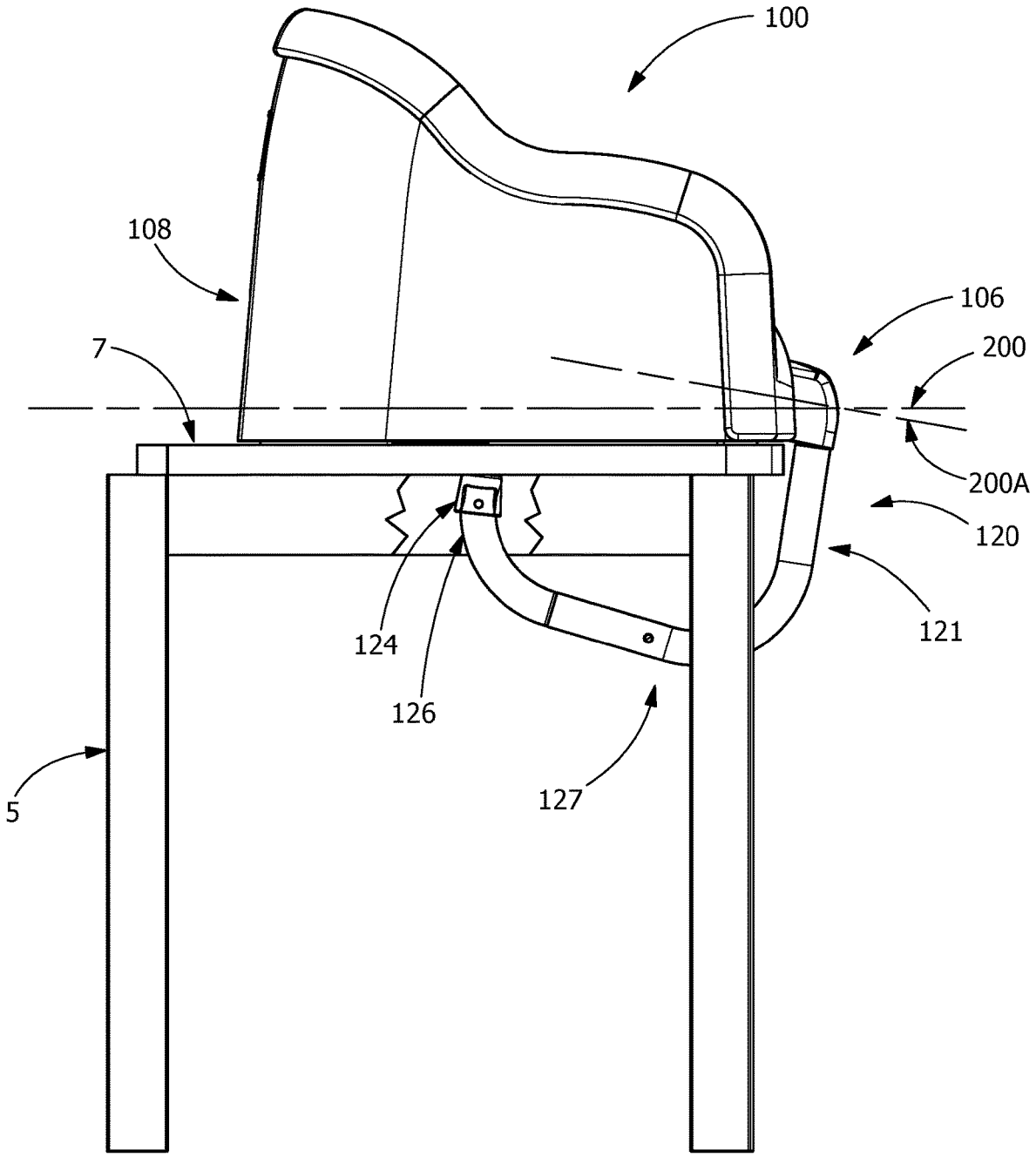
FIG. 1 is an elevation view of a quick connecting booster seat for a child embodying aspects of the present invention shown attached to a chair.
Figure 2:
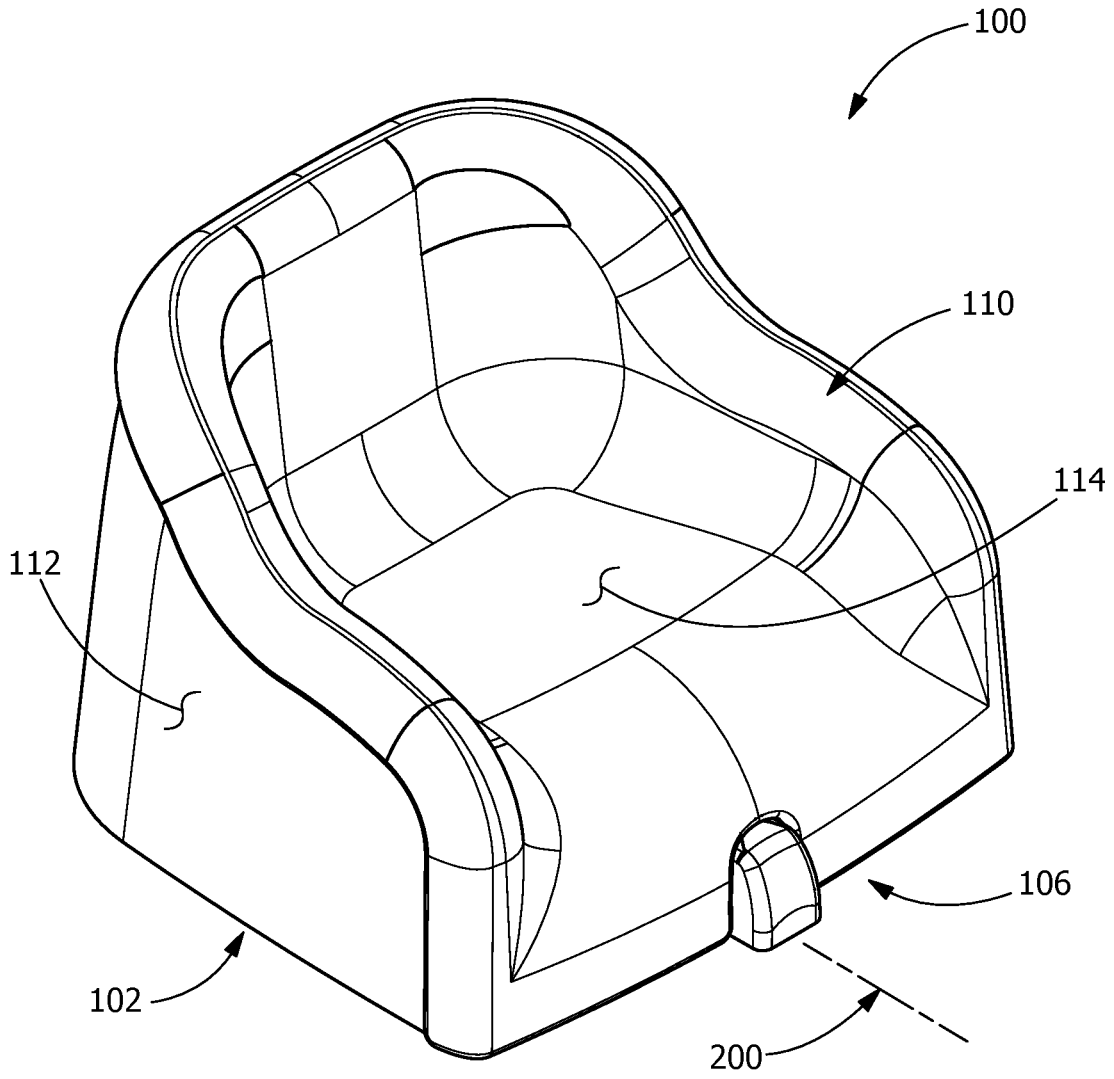
FIG. 2 is a perspective view of the quick connecting booster seat of FIG. 1.

Referring to the figures, a portable booster seat 100 embodying the present invention is shown in FIG. 1 positioned for use by attachment to a conventional chair 5. The booster seat 100 comprises a base 102 with a lower surface 104 for positioning on an upward-facing surface of a chair seat 7. A seat shell 110 extends upwardly from base 102 and has an exterior surface 112 configured to define an elevated seating area 114 for a child. The seat 100 and seating area are further defined as having a forward end 106 and a rearward end 108 defining a generally longitudinal first axis 200 therebetween. Seat shell 110 encloses a hollow interior space 118 above base 102 which contains a portion of a seat clamping mechanism 150 used to selectively secure the booster seat 100 to chair 5. The booster seat 100 is supported by adjacent contact between lower surface 104 and an upward-facing surface of chair seat 7 when positioned for use.

The lower surface 104 configuration defines a footprint preferably sized to fit within the periphery of seating surfaces of a large variety of chair types, particularly chairs used for dining. A footprint having dimension of approximately 16 inches by 16 inches number has been found suitable for most applications.

Figure 3:
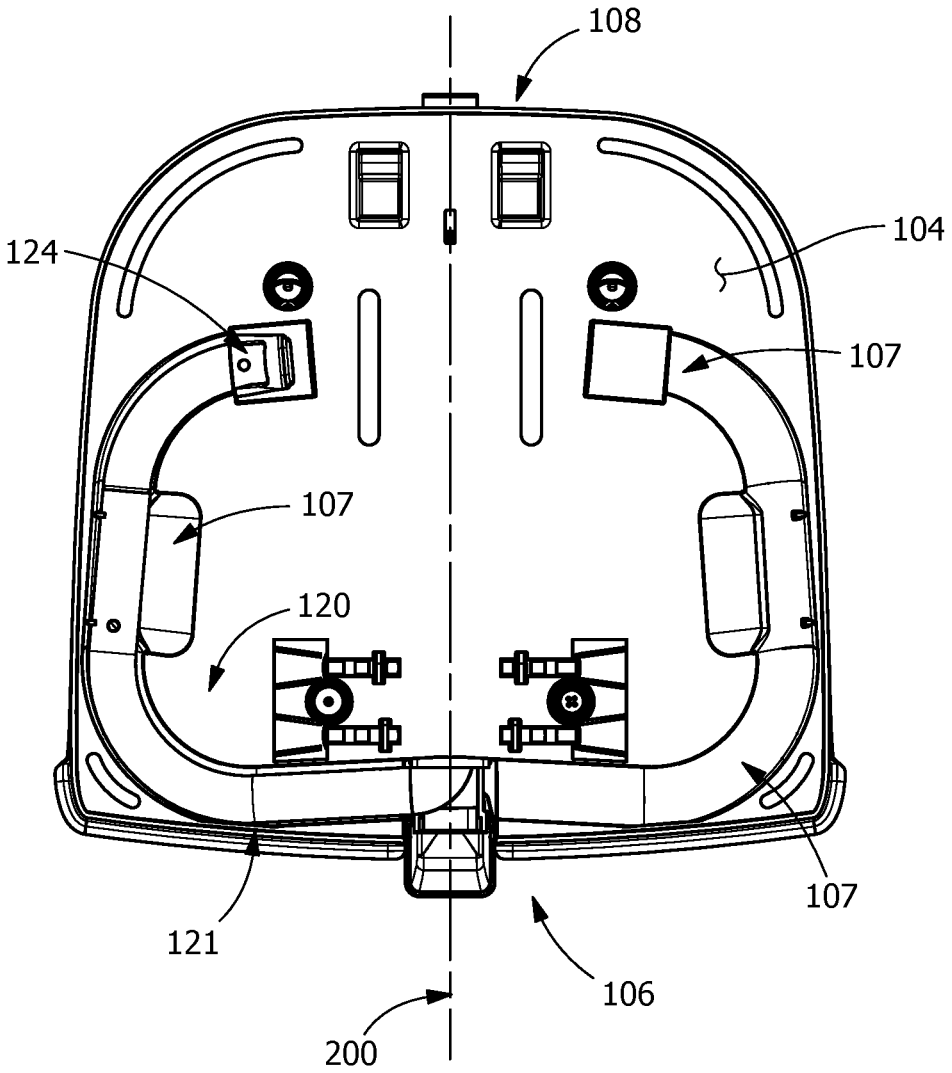
FIG. 3 is a view of the underside of the booster seat of FIG. 1 shown with a seat clamping apparatus in a stowed configuration.
Figure 4:
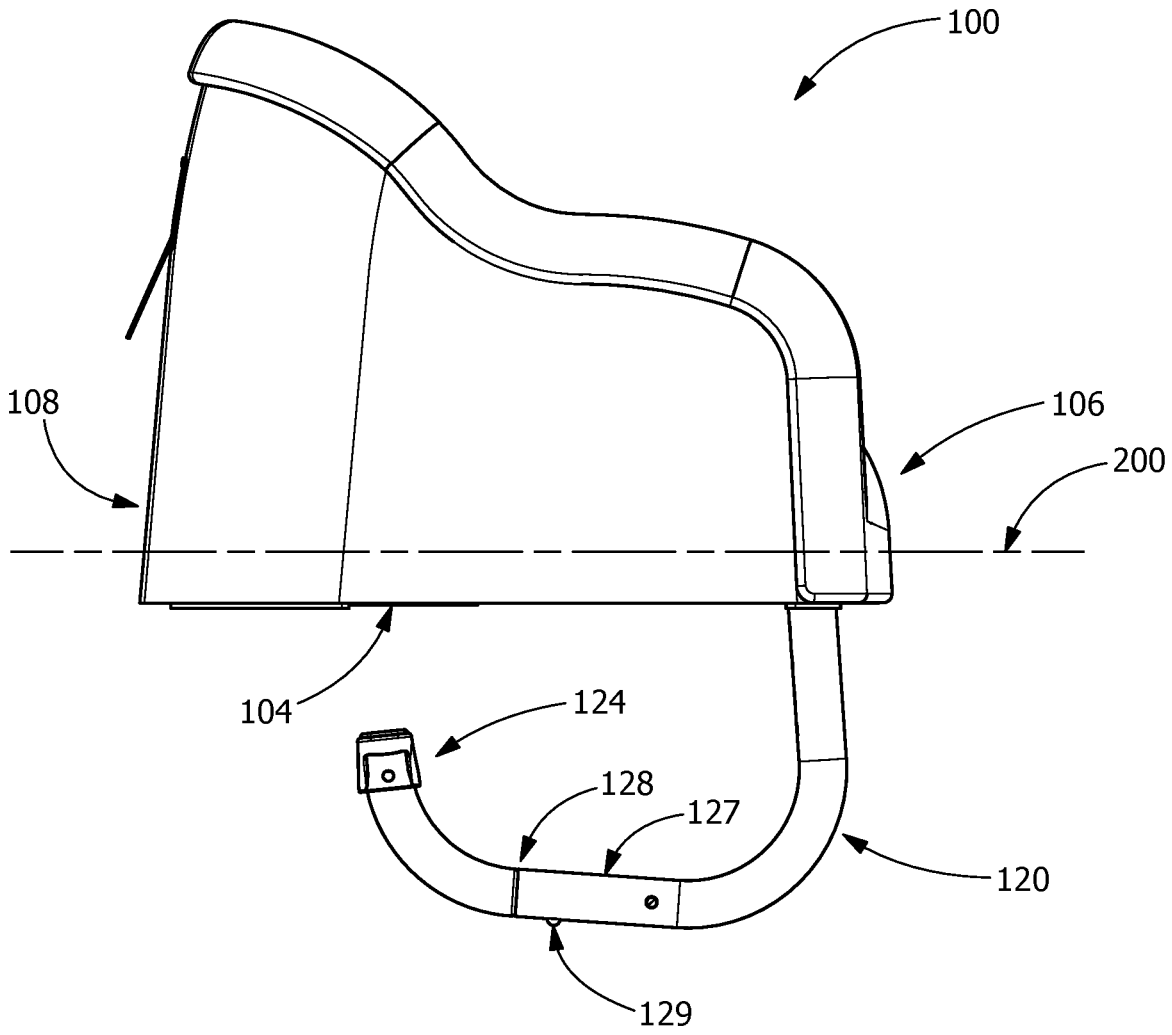
FIG. 4 is a side elevation view the booster seat of FIG. 1 shown with the clamping apparatus shown in the first step for repositioning in a preparation for clamping to a chair.

Clamping mechanism 150 is connected to the base 102 and includes a moveable, non-detachable clamping arm 120. The clamping mechanism 150 is configured to enable multiple modes of clamping arm movement. The clamping arm 120 may be axially displaced along first axis 100 between generally opposing retracted and extended positions, shown in FIGS. 4 and 5, respectively. When the clamping arm is in the retracted position, it may also be rotated about the first axis 200 between a clamping position (FIG. 4) and at least one storage position, best illustrated in FIG. 3. Axial movement of the clamping arm 120 along the first axis 200 may be prevented when the clamping arm is in the storage position. The clamping arm may also be rotated about a second axis 210 transverse or orthogonal to the first axis 200 while the clamping arm is in the extended and clamping positions.

Figure 9:
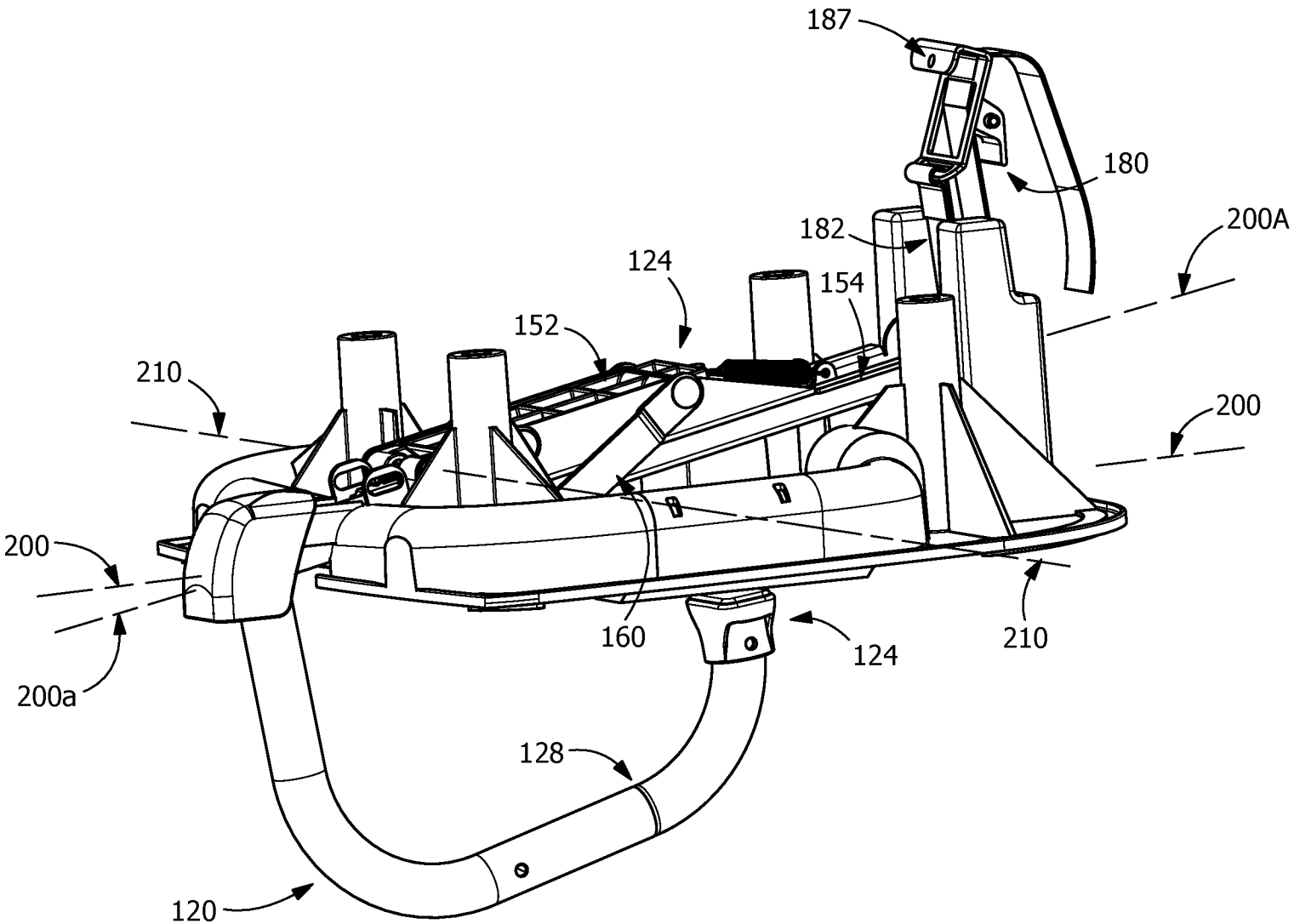
FIG. 9 is a partial view of the booster seat interior wherein the clamping mechanism is positioned as shown in FIG. 1.
Figure 10:
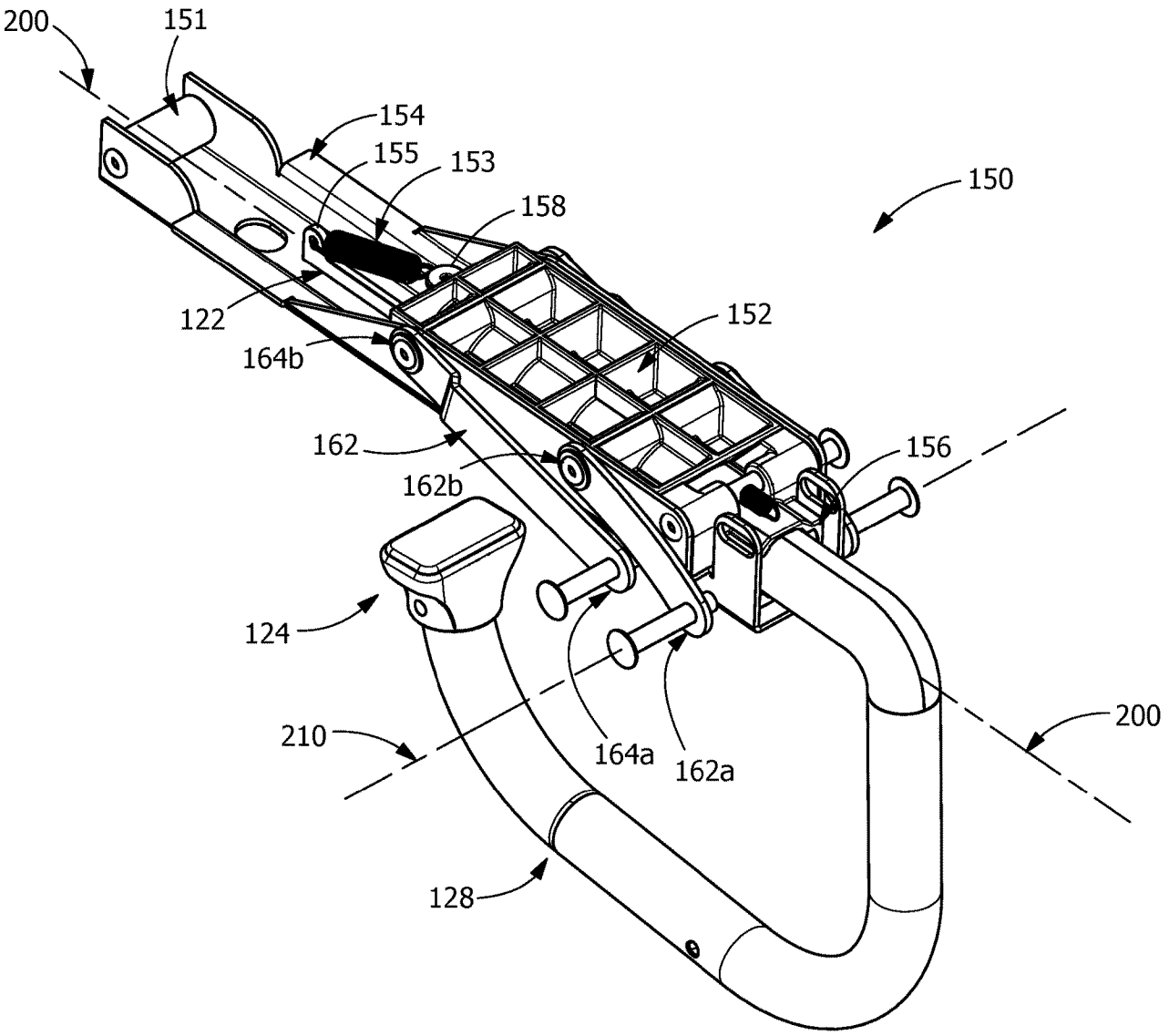
FIG. 10 is a partial view of the clamping arm and clamping mechanism of the booster seat.
Figure 11:
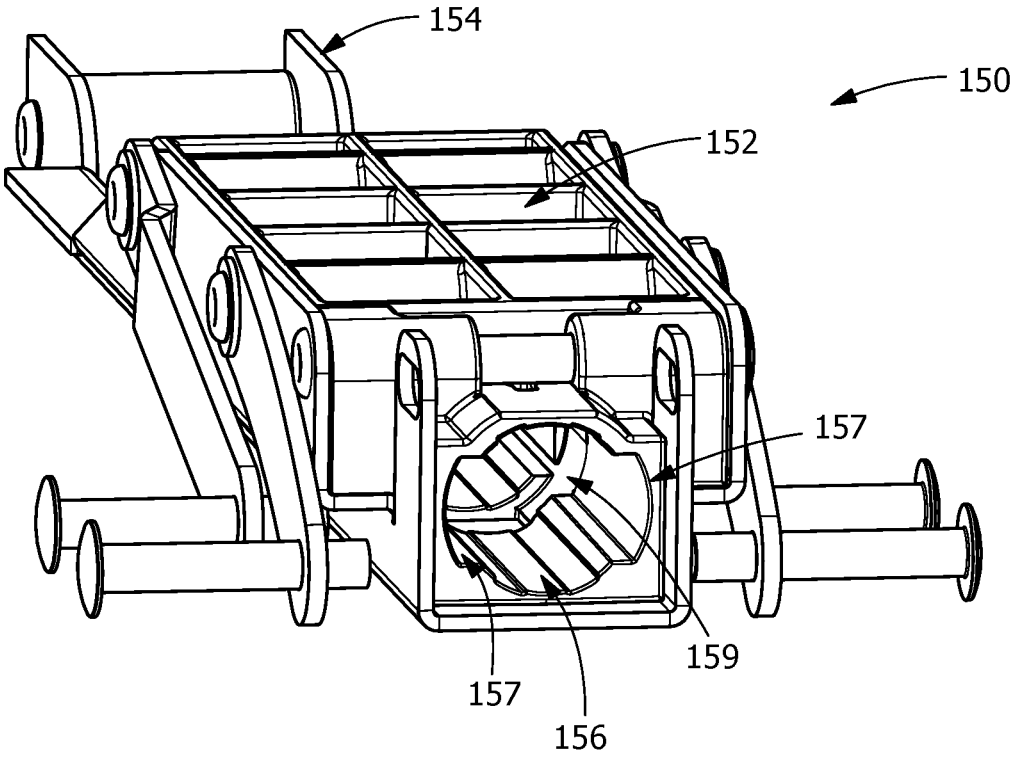
FIG. 11 is a detail view of a sliding block using in the clamping mechanism to manage motion of the clamping arm.
Figure 12:
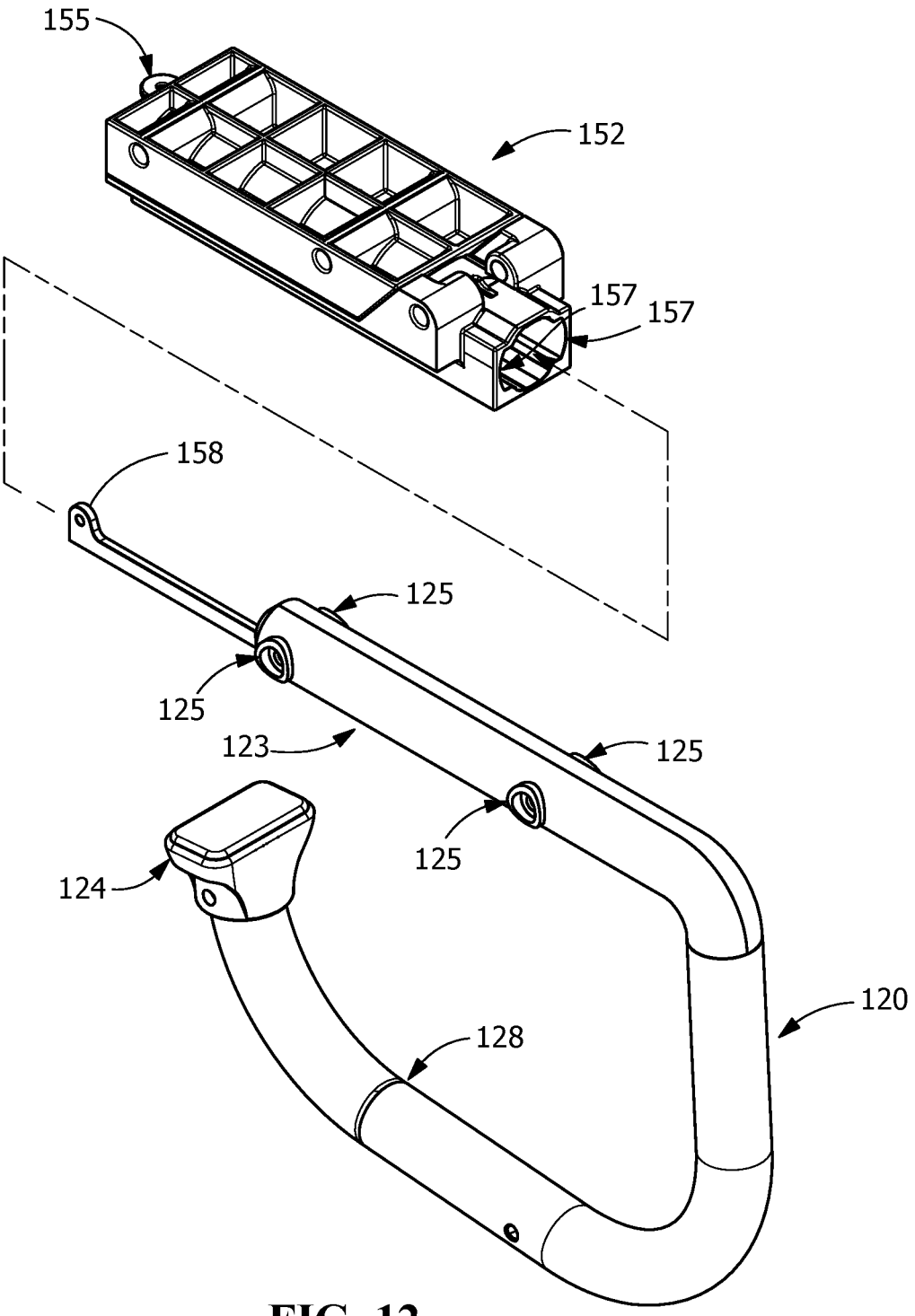
FIG. 12 is a partial exploded view of the sliding block and clamping arm.
Figure 13:
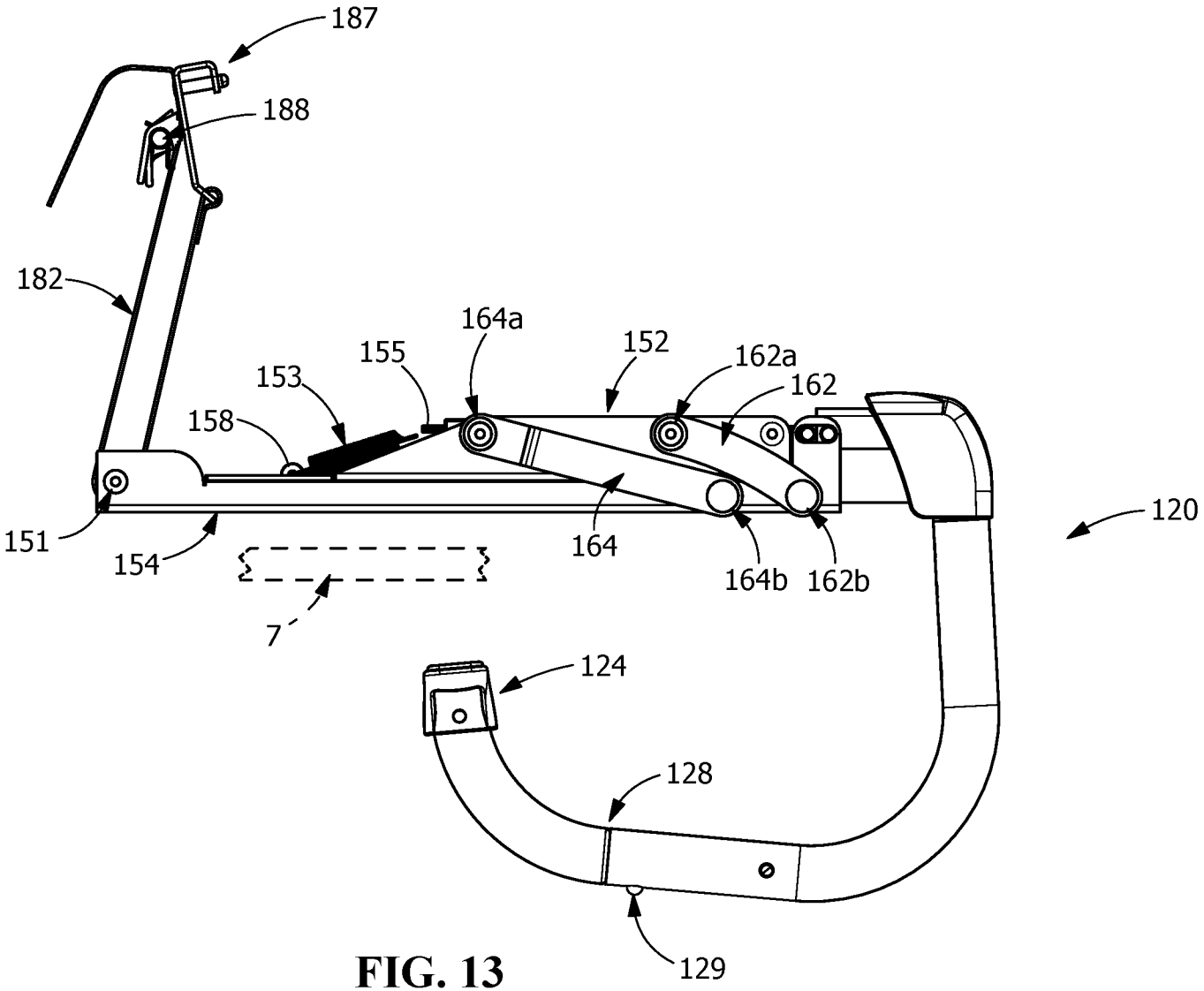
FIG. 13 is a partial view of an actuating mechanism shown in the released or unclamped position.
Figure 14:
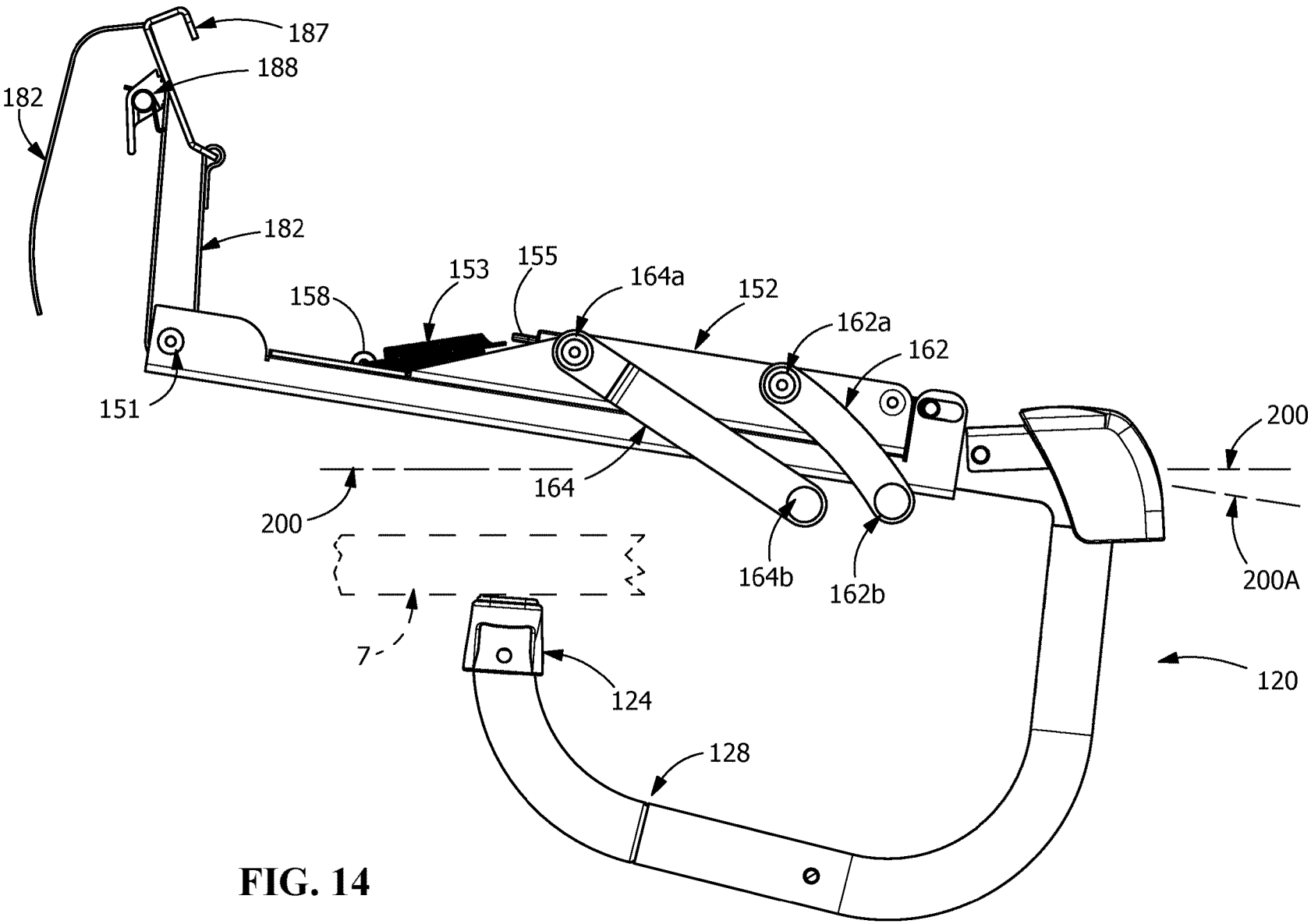
FIG. 14 is a partial view of the actuating mechanism of FIG. 13 shown when the clamping mechanism is in the clamped position.

Clamping mechanism 150 includes a slide block 152 and a lifting bracket 154 structurally connected thereto. Lifting bracket 154 is moveably disposed on the base assembly to effect rotational movement of the slide block 152 about the second axis 210 between generally opposing first (FIG. 9) and second positions (FIG. 10), corresponding to clamped and released configurations of the clamping mechanism. Second axis 210, also referred to as a transverse axis, is generally transversely aligned to the base and orthogonal to longitudinal first axis 200. Slide block 152 includes a guide opening 156 generally aligned with a longitudinal forward-rearward first axis 200 when the slide block in in the first position and is configured to receive an engagement portion 123 of the clamping arm 120 adjacent to a proximal or first end 122. Rotational movement of the slide block 152 from the first position causes the guide opening 156 to be angled from the first axis 200, corresponding to the released configuration of the clamp, to an angled axis alignment 200A when the slide block is moved to the second position, corresponding to the clamped configuration.

Guide opening 156 and the first end 122 of the clamping arm are configured to permit bi-directional movement of the clamping arm along the longitudinal first axis 200 between extended and retracted positions, and rotational movement of the clamping arm about the first axis 200 between storage and deployed positions. A resilient element 153 may be provided to bias movement of the clamping arm 120 toward the extended position. The resilient element may be a spring, elastomeric, or the like. Anchors 155, 158 may be provided on slide block 152 and clamp arm 120, respectively, to allow resilient element 153 to be connected and apply a biasing force on the clamping arm toward the extended position and on the slide block toward the first position.

The engagement portion 123 of the clamping arm and slide block 152 may include provisions to limit rotational movement to only when the clamping arm is in one or more pre-determined longitudinal positions. In a preferred embodiment, rotational movement of the clamping arm is allowed only when the clamping arm is in the retracted position. In one embodiment, engagement portion 123 of the clamping arm includes one or more lugs 125 radially extending from the engagement portion which engage guide bearings 157 in the guide opening to inhibit clamping arm rotation when it is not in the retracted position while allowing sliding movement along the longitudinal axis. Guide opening 156 may also include a guide channel 159 which permits the lugs 125 and the engagement portion 123 to rotate about first axis 200 when the clamping arm is in the retracted position and the lugs aligned in the guide channel 159. The engagement of lugs 125 in guide channel 159 may also restrain the clamping arm in the retracted position, resisting the biasing force of resilient element 153 toward the extended position. The interface between guide opening 156 and the first end 122 is configured to preclude detachment or separation of the clamping arm from the slide block by a user.

Clamping arm 120, when deployed for clamping use, is a generally C-shaped structure that extends from a forward end 106 of the base 102 forwardly, downwardly, and finally rearwardly to position a distal end 126 of the clamping arm 120 generally beneath and spaced apart from base 102. The clamping arm includes a drop-down portion 121 and a rearwardly extending extension portion 127 to which the distal end 126 connects, terminating in a clamping foot 124. This configuration allows the clamping arm 120 to extend generally around the forward end of the chair seat 7 and position clamping foot 124 beneath the underside of the chair seat so that the chair seat is positioned between clamping foot and the lower surface 104 allowing the chair seat to be clamped therebetween.

Clamping arm 120 may further include a rotary connection 128 configured to allow the distal end 126 and clamping foot 124 to be rotated about the axis of the extension portion 127. The rotary connection 128 may be configured to allow clamping foot rotation in either direction from its normally upright orientation when in use. Rotating the clamping foot, for example by approximately 90 degrees, increases the clearance between the clamping arm extension 127 and the underside of the chair, improving the ease of installing the booster seat 100 on the chair. The rotary connection 128 may be intermediately disposed in the extension portion 127 between the curved transitions to the clamping foot and the drop-down portion 121. The rotary connection 128 preferably includes a retaining mechanism 129 configured to releasably inhibit rotation of the clamping foot thereby properly aligning the clamping foot for use. The retaining mechanism 129 may be a spring ball engaging an opening in the extension portion, the position of the opening establishing the desired alignment of the clamping foot.

Longitudinal movement of the clamping arm along the first axis 200 is enabled between retracted (FIG. 4) and extended positions (FIG. 5) of the clamping arm. When in the retracted position, clamping arm 120 is disposed substantially within the footprint of the base when viewed from above. When moved to the extended position, a portion of the clamping arm projects forwardly beyond the footprint of the base. Detents or similar provisions may be provided in the interface between the first portion and the guide opening to bias the clamping arm into one or more preferred positions along the longitudinal axis. A resilient element 153 may be provided to bias the longitudinal position of clamping arm 120. In the illustrated embodiment, clamping arm 120 is biased toward the extended position. The clamping arm is configured to remain non-detachably connected to the seat 100 in to simplify use and storage by a caregiver and provide a compact assembly when the clamping arm is stored. The clamping arm 120 is integral to the seat 100 and not intended to be separable from the seat during normal use or operation.

In one embodiment, slide block 152 may be pivotally coupled to the base 102 adjacent to a forward end 107 of the seat enabling clamping arm 120 to be angled as the slide block 152 is rotated about the transverse axis 210 from the first position toward the second position, shifting the first axis 200 to angled axis alignment 200A. Angling of the clamping arm 120 brings distally located clamping foot 124 into contact with the lower surface of the chair seat enabling the seat to be secured to the chair. The pivotal coupling may be a hinge.

In another embodiment, slide block 152 may be connected to base 102 by a linkage 160 including a forward link 162 and a rearward link 164. The links 162, 164 are pivotally coupled at opposing ends to the base and sliding block, respectively, with the opposing pivots 162*a*, 162*b* of the forward link being more closely spaced than the opposing pivots 164*a*, 164*b* of the rearward link. The different lengths of the links cause the slide block 152 to not only be angularly rotated about transverse axis 210 as it moves from the first position to the second position, but also to displace the slide block 152 and clamping arm 120 slightly forwardly in relation to the seat base. The forward displacement of the slide block 152 and the clamping arm 120 improves clearance between the drop-down portion 121 clamping arm and the forward edge of the chair when the seat is installed.

Figure 5:
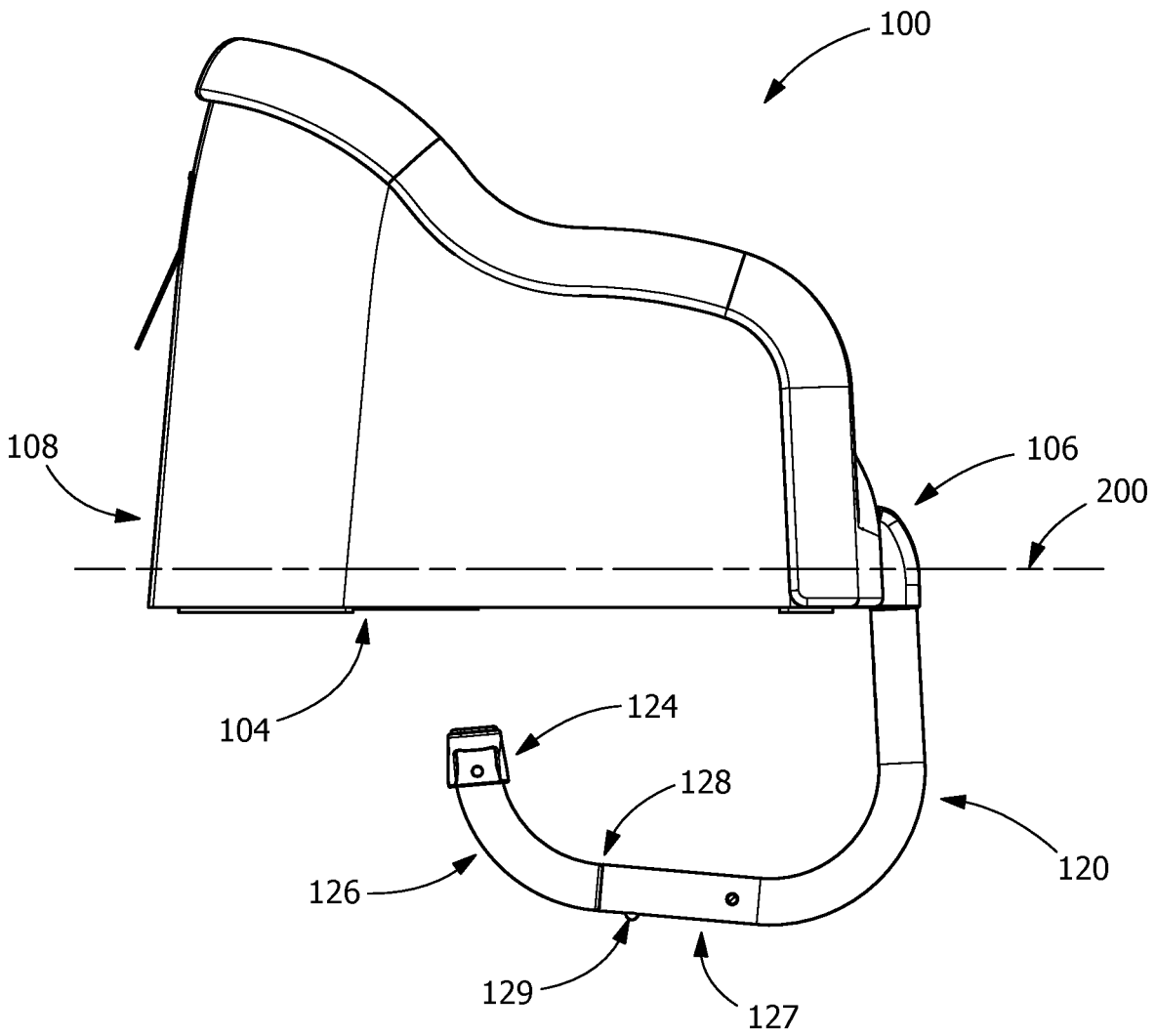
FIG. 5 is a side elevation view of the booster seat shown in FIG. 4, wherein the clamping apparatus has been extended in preparation for clamping to the chair.
Figure 6:
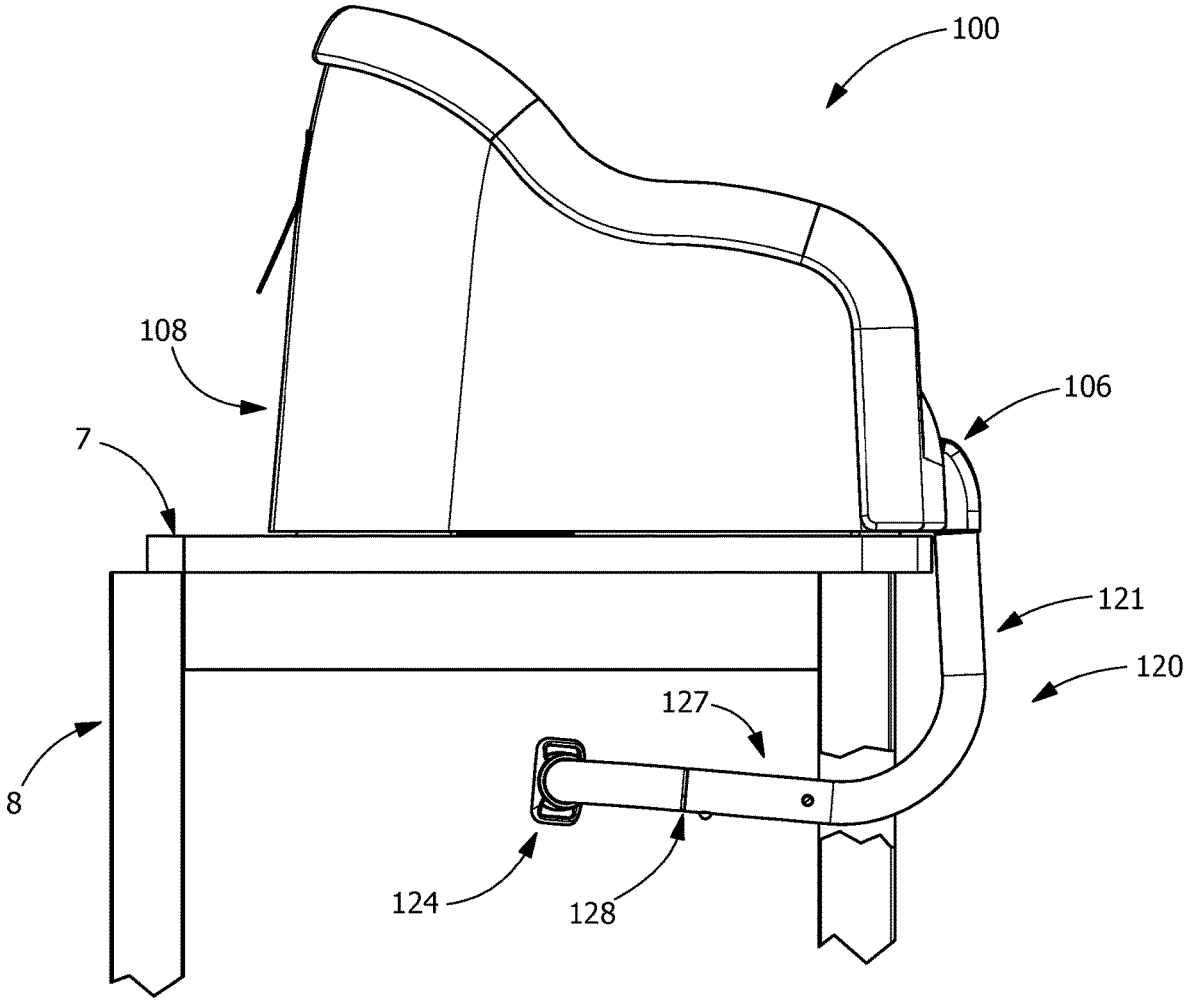
FIG. 6 is a side elevation view of the of the booster seat shown in FIG. 5, wherein the clamping apparatus is repositioned to ease installation on the chair.
Figure 7:
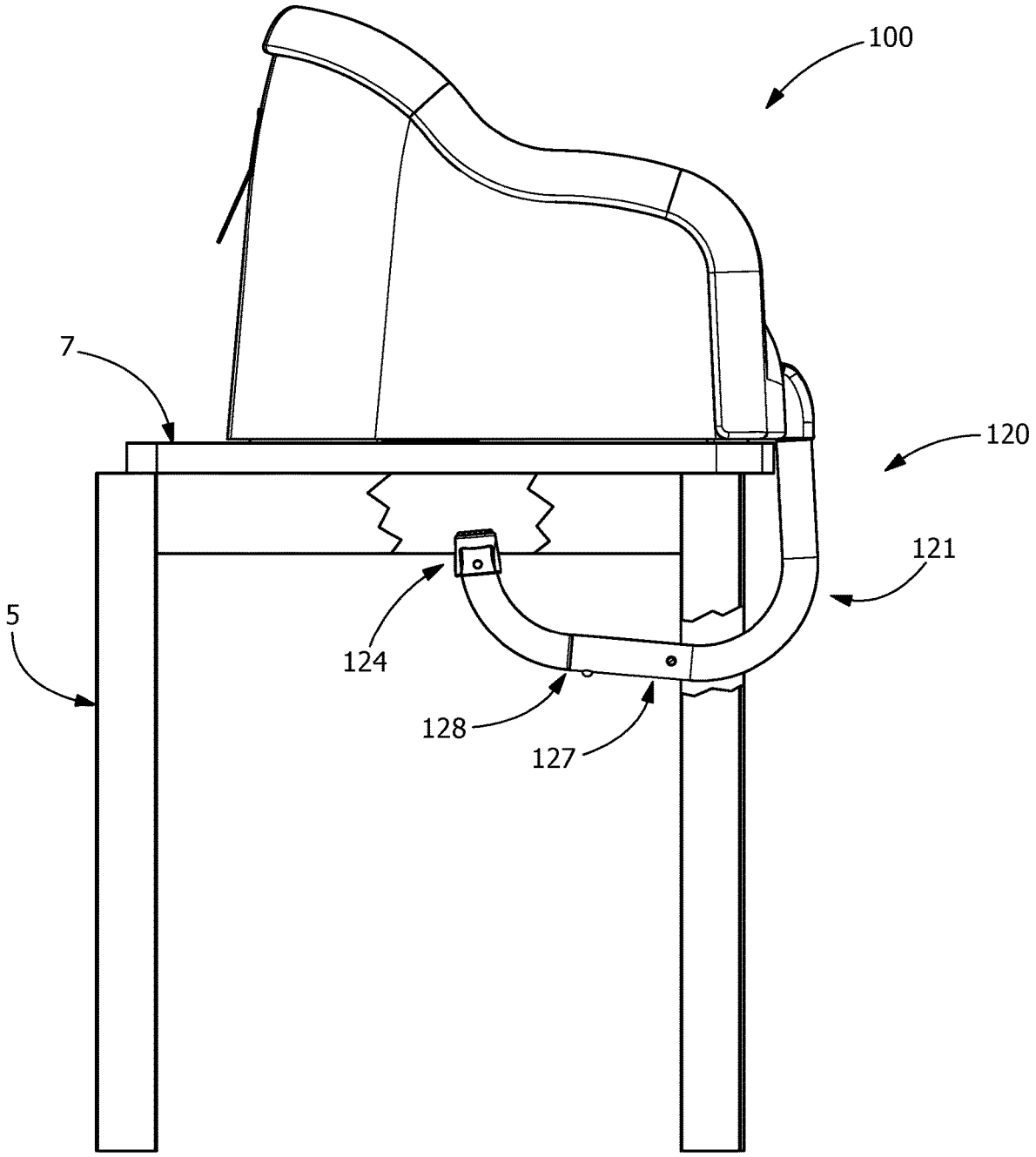
FIG. 7 is a side elevation view of the booster seat shown in FIG. 5, wherein the clamping apparatus is positioned in preparation for clamping to the chair.
Figure 8:
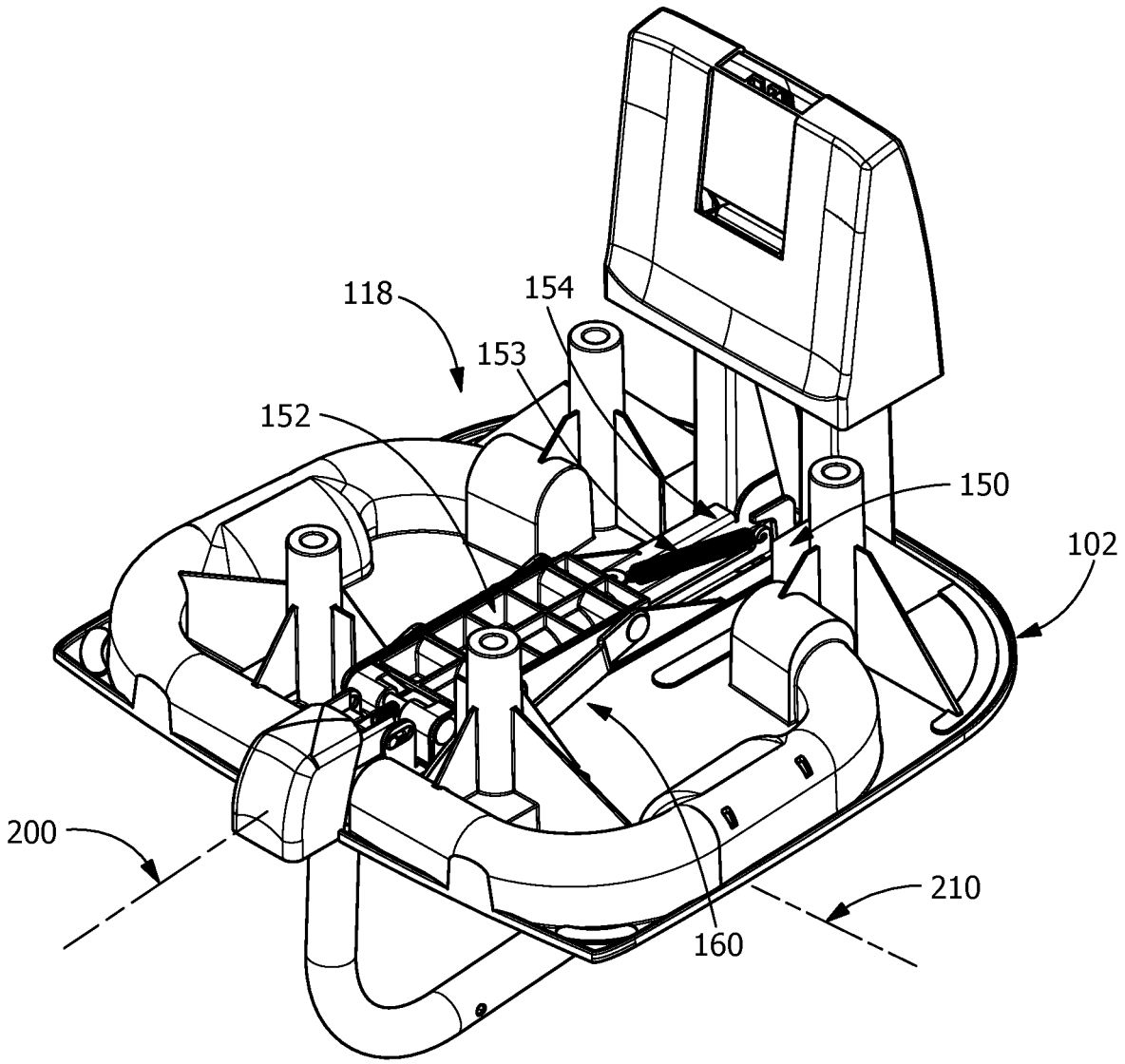
FIG. 8 is a partial interior view of the booster seat interior wherein the clamping mechanism is positioned as shown in FIG. 5.

Rotational movement of the clamping arm about the first axis 200 is enabled by the interface between the first portion of the clamping arm 120 and the guide opening 156. The rotational movement allows the clamping arm to be positioned in at least one storage position (FIG. 3) and a clamping position (FIG. 5). Rotational movement of the clamping arm about the first axis may be prevented except when the clamping arm is in the retracted position (FIG. 4) to prevent instability when clamping. Rotating the clamping arm into the clamping position locates the second or distal end 124 of clamping arm 120 generally beneath and spaced apart from lower surface 104 to permit a chair seat to occupy the space between. Axial movement of the clamping arm along the first axis is permitted with the clamping arm is in the clamping position, moving from the retracted position used for storage to the extended position for use of the clamp. Rotating the clamping arm to the storage position orients the clamping arm such that it is substantially disposed above the plane of lower surface 104 in a recessed receptacle 107 in the lower surface 104 so that it does not project beneath the lower surface 104. The recess receptacle 107 may include symmetric recesses on either side of longitudinal axis 200 to allow storage of the clamping arm by rotation in either direction from the deployed position. Axial movement of the clamping arm along the first axis may be prevented when the clamping arm is rotated into the storage position. The storage position orientation of the clamping arm allows the lower surface to rest stably adjacent to a generally flat supporting surface. The recess receptacle and storage position of the clamp arm 120 also allow the booster seat 100 to be compactly configured as a unitary assembly without separating the clamping arm 120 from the seat.

Moving the clamping arm 120 to the extended position requires rotating the clamping arm 120 approximately 90 degrees about longitudinal axis 200 to the clamping position (FIG. 4) so that it is no longer disposed within the receptacle 107. Once removed from the confines of the receptacle, the clamping arm 120 may be urged along first axis 200 toward the front of the seat by the resilient element 153 until the clamping arm reaches the extended position (FIG. 5). The combined sliding and rotational movement of the clamping arm to simultaneous extended and clamping positions allows the hook formed by drop-down portion 121 and extension portion 127 of the clamping arm to extend around the forward edge to the underside of the chair seat while allowing the bottom surface 104 to fully rest upon the chair seat. Additional clearance may be provided by rotating the clamping foot approximately 90 degrees about the axis of extension portion 127 using rotary connection 128 to reposition the clamping foot 124 and increase the separation of the near-most portion of the clamping arm to the underside of the chair.

An actuating mechanism 180 may be provided to reposition the clamping mechanism 150 and selectively retain the clamping mechanism in the clamped position. The actuating mechanism 180 includes a tensioning structure 182 connecting an anchor connector 151 on the lifting bracket 154 and a fixed anchor 187 on the seat structure. The tensioning structure 182 may comprise a web member acting directly or in a force-multiplying loop actuating mechanism to raise and lower the end of lifting bracket opposite of the slide block thereby angling the slide block by rotation and repositioning the clamping arm. A cam-lock style web clamp 188 may be provided and affixed to the booster seat structure to enable tension in the tensioning structure, and thereby the clamping force at the clamping foot, to be retained. Other mechanisms to elevate and retain the lifting arm in an elevated position which angles the slide block about the second axis are contemplated within the scope of this invention.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

We claim:

1. A portable seat for attachment to a chair to support a child thereon, the portable seat comprising:

a base;

a clamping arm; and a clamping mechanism non-detachably connecting the clamping arm to the base, the clamping mechanism configured to enable bi-directional axial clamping arm movement along a first axis between opposing extended and retracted positions, and rotational movement about the first axis while the clamping arm is in the retracted position between a storage alignment and a clamping alignment, the clamping mechanism also enabling clamping arm rotation about a second axis, the second axis being orthogonal to the first axis, movement of the clamping arm about the second axis while the clamping arm is in the clamping alignment altering separation between a clamping foot disposed at a distal end of the clamping arm and the base enabling a portion of the chair to be clamped therebetween.

2. The portable seat of claim 1, wherein the clamping arm has a rotary connection configured to enable clamping foot rotation relative to the clamping arm.

3. The portable seat of claim 2, wherein the clamping arm further comprises a retaining mechanism configured to releasably inhibit clamping foot rotation.

4. The portable seat of claim 1, wherein the clamping mechanism further comprises a slide block connected to the base and rotatable about the second axis between a first position and a second position, the slide block having a guide opening symmetrically arranged about the first axis into which a first end of the clamping arm is received, movement of the slide block angling the first axis relative to the base.

5. The portable seat of claim 4, wherein the clamping mechanism further comprises a lifting bracket connecting the slide block to the base.

6. The portable seat of claim 5, wherein the lifting bracket connection to the base is a pivoting connector.

7. The portable seat of claim 5, wherein the lifting bracket connection to the base includes a linkage comprising a first link and a second link, each link being pivotally coupled at a first end to the base and at a second end to the lifting bracket, wherein the first link and the second link have different lengths.

8. The portable seat of claim 5, further comprising an actuating mechanism configured to selectively move the lifting bracket thereby moving the slide block between the first and second positions, and to releasably retain the slide block in the second position.

9. The portable seat of claim 8, wherein the actuating mechanism comprises a web member and a selectively releasable web clamp, the web member extending between a fixed anchor connected to the base and an end of the lifting bracket, applying a tension force to the web member moving the slide block toward the second position, the web clamp maintaining the tension force in the web member until selectively released to de-tension the web member and allow the lifting bracket to return to the first position.

10. The portable seat of claim 4, further comprising a resilient element configured to bias the clamping arm toward the extended position and the slide block toward the first position.

11. The portable seat of claim 1, wherein the base further comprises a recess configured to receive a portion of the clamping arm when in the retracted position and storage alignment and position the clamping arm substantially above a bottom surface of the base thereby enabling the base to stably rest on a surface.

12. A clamping mechanism for securing a portable seat to a chair to support a child thereon, the clamping mechanism comprising:

a clamping arm; and a slide block non-detachably connected to a proximal end of the clamping arm, the slide block configured to enable bi-directional axial clamping arm movement along a first axis between opposing extended and retracted positions, and rotational movement about the first axis while the clamping arm is in the retracted position between a storage alignment and a clamping alignment, the clamping mechanism also enabling clamping arm rotation about a second axis between opposing first and second positions, the second axis being orthogonal to the first axis.

13. The clamping mechanism of claim 12, wherein the clamping arm further comprises a rotary connection coupling a distal end with a clamping foot to the clamping arm, the rotary connector configured to enable clamping foot rotation about an axis parallel to the first axis.

14. The clamping mechanism of claim 13, wherein the clamping arm further comprises a retaining mechanism configured to releasably secure the clamping foot in at least one rotational orientation.

15. The clamping mechanism of claim 12, further comprising a lifting bracket connecting the slide block to the seat.

16. The clamping mechanism of claim 15, wherein the lifting bracket connection to the seat is a pivoting connector.

17. The clamping mechanism of claim 15, wherein the lifting bracket connection to the seat includes a linkage comprising a first link and a second link, each link being pivotally coupled at a first end to the seat and at a second end to the lifting bracket, wherein the first link and the second link have different lengths.

18. The clamping mechanism of claim 12, further comprising a resilient element configured to bias the clamping arm toward the extended position and the slide block toward the first position.

* * * * *